US007960918B2

(12) United States Patent
Adachi et al.

(10) Patent No.: US 7,960,918 B2
(45) Date of Patent: Jun. 14, 2011

(54) ELECTRONIC DEVICE AND LIGHT EMISSION CONTROL METHOD FOR ELECTRONIC DEVICE

(75) Inventors: Masahiro Adachi, Tottori (JP); Yutaka Hashimoto, Tottori (JP); Katsuhisa Kanzaki, Tottori (JP); Tomoki Abe, Tottori (JP); Hirofumi Kasada, Tottori (JP); Koshi Ando, Tottori (JP)

(73) Assignee: Tottori University, Tottori (JP)

( * ) Notice: Subject to any disclaimer, the term of this patent is extended or adjusted under 35 U.S.C. 154(b) by 660 days.

(21) Appl. No.: 11/992,592

(22) PCT Filed: Feb. 4, 2008

(86) PCT No.: PCT/JP2008/051754

§ 371 (c)(1),
(2), (4) Date: Mar. 26, 2008

(87) PCT Pub. No.: WO2008/096701

PCT Pub. Date: Aug. 14, 2008

(65) Prior Publication Data

US 2010/0156311 A1 Jun. 24, 2010

(30) Foreign Application Priority Data

Feb. 4, 2007 (JP) ..... 2007-024939

(51) Int. Cl.
*H05B 41/30* (2006.01)

(52) U.S. Cl. ..... 315/246; 315/287

(58) Field of Classification Search ..... 315/287, 315/224, 169.1, 169.3, 246; 372/38.02, 38.1, 372/38.08, 34, 24, 50.121; 345/82, 76, 78; 313/503, 504; 257/79, 88, 89
See application file for complete search history.

(56) References Cited

U.S. PATENT DOCUMENTS

| | | | | |
|---|---|---|---|---|
| 5,105,429 | A * | 4/1992 | Mundinger et al. | 372/34 |
| 5,809,052 | A | 9/1998 | Seko et al. | |
| 5,936,986 | A * | 8/1999 | Cantatore et al. | 372/38.02 |
| 6,548,960 | B2 * | 4/2003 | Inukai | 315/169.3 |
| 6,730,934 | B2 * | 5/2004 | Yamada et al. | 257/79 |
| 7,129,918 | B2 * | 10/2006 | Kimura | 345/82 |
| 7,483,458 | B2 * | 1/2009 | Bhatia et al. | 372/38.02 |

FOREIGN PATENT DOCUMENTS

| | | |
|---|---|---|
| JP | A 9-52389 | 2/1997 |
| JP | A 2000-133873 | 5/2000 |
| WO | WO 2004/057561 A1 | 7/2004 |

OTHER PUBLICATIONS

"Picosecond Pulsed Diode Laser Driver," Pulsed Light Sources, http://www.picoquant.com/products/pd1800b/pd1800b.htm.

* cited by examiner

*Primary Examiner* — Jacob Y Choi
*Assistant Examiner* — Ephrem Alemu
(74) *Attorney, Agent, or Firm* — Oliff & Berridge, PLC

(57) ABSTRACT

An electronic device, and a corresponding light emission control method for the electronic device, emit light by utilizing recombination of electrons and holes the device and method input a pulse-shaped driving signal having a duty ratio higher than or equal to 0.7 and lower than 1.0 and thereby causing light to be emitted intermittently. When an electron density is denoted by n, a hole density by p, a thermal velocity of electrons by $V_{th:n}$, a thermal velocity of holes by $V_{th:p}$, an electron capture cross section of a defect level by $\sigma_n$, a hole capture cross section of a defect level by $\sigma_p$, and a pulse width of the driving signal by W, the input driving signal has a pulse width W that satisfies $W<1/\{n\cdot v_{th:n}\cdot\sigma_n\cdot p\cdot v_{th:p}\cdot\sigma_p/(n\cdot v_{th:n}\cdot\sigma_n+p\cdot v_{th:p}\cdot\sigma_p)\}$.

4 Claims, 9 Drawing Sheets

ELECTRONIC DEVICE AND LIGHT EMISSION CONTROL METHOD FOR ELECTRONIC DEVICE

BACKGROUND OF THE INVENTION

1. Field of the Invention

The present invention relates to an electronic device and a light emission control method for the electronic device and, in particular, to: an electronic device having a light emitting section that emits light by utilizing recombination of electrons and holes; and a light emission control method for this electronic device.

2. Description of the Related Art

Recently, as the light source of a floodlighting device, a lighting device, and the like, an electronic device is used more frequently that has a light emitting section that emits light using a P-N junction of a semiconductor. In particular, an electronic device is also known that employs a light emission structure in which an active layer such as a quantum well active layer is provided between a P-type semiconductor layer and an N-type semiconductor layer that constitute a P-N junction so that light emission is performed effectively.

In an electronic device having such a light emitting section, when a required driving signal is inputted to the light emitting section, carriers consisting of free electrons and free holes recombine with each other in the P-N junction region or the active layer of the light emitting section so that the light emission phenomenon is generated.

As known, in the light emitting section, at the time of light emission, Joule heat is generated by the resistance components of the semiconductor layer part such as the P-type semiconductor layer, the N-type semiconductor layer, and the active layer. Then, the Joule heat generates defects in the crystal structure of the semiconductor layer so as to reduce the optical output power of the light emitting section as time advances.

Further, according to the findings of the present inventors, each defect level present in the semiconductor layer part of a light emitting section captures an electron and a hole and then causes them to recombine with each other. Then, recombination energy released in accordance with this recombination is released as heat energy. This heat energy then causes multiplication and diffusion of defect levels in the semiconductor layer so as to degrade the semiconductor layer.

Then, when the semiconductor layer is degraded, the efficiency of recombination of electrons and holes decreases in the P-N junction region or the active layer, and hence the luminance of light emission decreases. Thus, in such a light emitting section and an electronic device having such a light emitting section, when the luminance of the light emitting section goes to or below a desired luminance, it is determined that the product lifetime has been reached and hence the light emitting section needs to be replaced.

A longer lifetime of the light emitting section is more preferable. Thus, in the prior art, enhancement of the lifetime of the light emitting section has been achieved by reducing the density of the defect levels itself generated in the semiconductor layer part of the light emitting section at a manufacturing stage.

Alternatively, according to a proposal having been made so far, focusing attention on Joule heat, a pulsed driving signal is inputted to a light emitting section so that the light emitting section is brought into an ON state and an OFF state alternately so as to emit light intermittently. By virtue of this, energization duration per unit time is reduced, and hence heat generation is reduced in the light emitting section. As a result, lifetime improvement is achieved (see, for example, Patent Document 1).

A detailed method is as follows. When a temperature increase that occurs in the light emitting section in a case that continuous energization is performed on the light emitting section so that continuous light emission is performed is denoted by $\Delta T_0$ while a temperature increase that occurs in the light emitting section in a case that a pulsed driving signal is inputted to the light emitting section so that intermittent light emission is performed is denoted by $\Delta T_1$, a pulsed driving signal is adopted that has a pulse width and a duty ratio satisfying a condition $\Delta T_1/\Delta T_0<1/2$ (see, for example, Patent Document 2).

Further, according to another proposal, when a semiconductor laser is employed which has a threshold current $I_0$ and a slope efficiency $\eta$ and in which an injection current dependence of the lifetime in continuous light emission is approximated as $\tau(I)=cI^{-r}$ (here, I is an injection current and c is a constant) in an output area of interest, an output P satisfying $$\{(I_0+P/\eta)/(I_0+P_0/\eta)\}^r<P/P_0$$

for a required average output P0 is adopted as well as a duty ratio $\beta=P_0/P$ (see, for example, Patent Document 3).

[Patent Document 1] International Publication No. 2009/057561 Pamphlet

[Patent Document 2] Japanese Published Unexamined Patent Application No. H09-052389

[Patent Document 3] Japanese Published Unexamined Patent Application No. 2000-133873

Nevertheless, according to the proposed duty ratio conditions, in order that the effect of lifetime improvement should be obtained, a duty ratio lower than 0.4 needs to be adopted. When such a low duty ratio is adopted, the apparent luminance of the light emitting section decreases remarkably, and hence this condition is not a practical operating condition. This has been a problem.

That is, in such an electronic device having a light emitting section, in general, operation is performed in such a manner that the light emitting section always emits light so that a higher luminance is obtained. Thus, a duty ratio as close to 1.0 as much as possible is desired, and hence a duty ratio reduced to 0.7 or lower is not practical.

On the other hand, according to the findings of the present inventors, one of the causes degrading the semiconductor layer of the light emitting section is recombination of electrons and holes in defect levels present in the semiconductor layer. Further, this process has a remarkably large influence. Thus, we have recognized that when attention is focused on defect levels, lifetime improvement of the light emitting section can be achieved regardless of the duty ratio.

SUMMARY OF THE INVENTION

That is, the present inventors have accomplished the present invention in which a duty ratio higher than 0.7 is adopted such that a desired luminance is obtained easily and still lifetime improvement of a light emitting section is achieved so that lifetime improvement of an electronic device having a light emitting section is achieved.

The electronic device according to the present invention is an electronic device including: a light emitting section that emits light by utilizing recombination of electrons and holes; and a driving section that inputs to the light emitting section a pulse-shaped driving signal having a duty ratio higher than or equal to 0.7 and lower than 1.0 and thereby causes the light emitting section to emit light intermittently, wherein when an electron density is denoted by n, a hole density is denoted by p, a thermal velocity of electrons is denoted by $v_{th:n}$, a thermal velocity of holes is denoted by $v_{th:p}$, an electron capture cross section of a defect level present in the light emitting section is denoted by $\sigma_n$, a hole capture cross section of a defect level present in the light emitting section is denoted by $\sigma_p$, and a pulse width of the driving signal is denoted by W, the driving section inputs to the light emitting section the driving signal having a pulse width W that satisfies $$W<1/\{n\cdot v_{th:n}\cdot\sigma_n\cdot p\cdot v_{th:p}\cdot\sigma_p/(n\cdot v_{th:n}\cdot\sigma_n+p\cdot v_{th:p}\cdot\sigma_p)\}.$$

In particular, another feature is that the pulse width W of the driving signal is set to be $W<1/n\cdot v_{th:n}\cdot\sigma_n$ in a case of $n\cdot v_{th:n}\cdot\sigma_n<<p\cdot v_{th:p}\cdot\sigma_p$ and to be $W<1/p\cdot v_{th:p}\cdot\sigma_p$ in a case of $n\cdot v_{th:n}\cdot\sigma_n>>p\cdot v_{th:p}\cdot\sigma_p$.

Further, the light emission control method for an electronic device according to the present invention is a light emission control method for an electronic device, including a step of inputting, to a light emitting section that emits light by utilizing recombination of electrons and holes, a pulse-shaped driving signal having a duty ratio higher than or equal to 0.7 and lower than 1.0 and thereby causing the light emitting section to emit light intermittently, wherein when an electron density is denoted by n, a hole density is denoted by p, a thermal velocity of electrons is denoted by $v_{th:n}$, a thermal velocity of holes is denoted by $v_{th:p}$, an electron capture cross section of a defect level present in the light emitting section is denoted by $\sigma_n$, a hole capture cross section of a defect level present in the light emitting section is denoted by $\sigma_p$, and a pulse width of the driving signal is denoted by W, $$W<1/\{n\cdot v_{th:n}\cdot\sigma_n\cdot p\cdot v_{th:p}\cdot\sigma_p/(n\cdot v_{th:n}\cdot\sigma_n+p\cdot v_{th:p}\cdot\sigma_p)\}$$

is satisfied.

In particular, another feature is that the pulse width W of the driving signal is set to be $W<1/n\cdot v_{th:n}\cdot\sigma_n$ in a case of $n\cdot v_{th:n}\cdot\sigma_n<<p\cdot v_{th:p}\cdot\sigma_p$ and to be $W<1/p\cdot v_{th:p}\cdot\sigma_p$ in a case of $n\cdot v_{th:n}\cdot\sigma_n>>p\cdot v_{th:p}\cdot\sigma_p$.

According to the present invention, since the pulse width W of a driving signal is set to be $$W<1/\{n\cdot v_{th:n}\cdot\sigma_n\cdot p\cdot v_{th:p}\cdot\sigma_p/(n\cdot v_{th:n}\cdot\sigma_n+p\cdot v_{th:p}\cdot\sigma_p)\}$$

recombination of electrons and holes in defect levels is suppressed even when the duty ratio of the driving signal is 0.7 or higher. Thus, generation of recombination energy released in accordance with the recombination of electrons and holes in defect levels can be suppressed so that degradation of the semiconductor layer of the light emitting section can be suppressed. This realizes lifetime improvement of a light emitting section and hence lifetime improvement of an electronic device having this light emitting section.

DETAILED DESCRIPTION OF THE PREFERRED EMBODIMENTS

Figure 1:
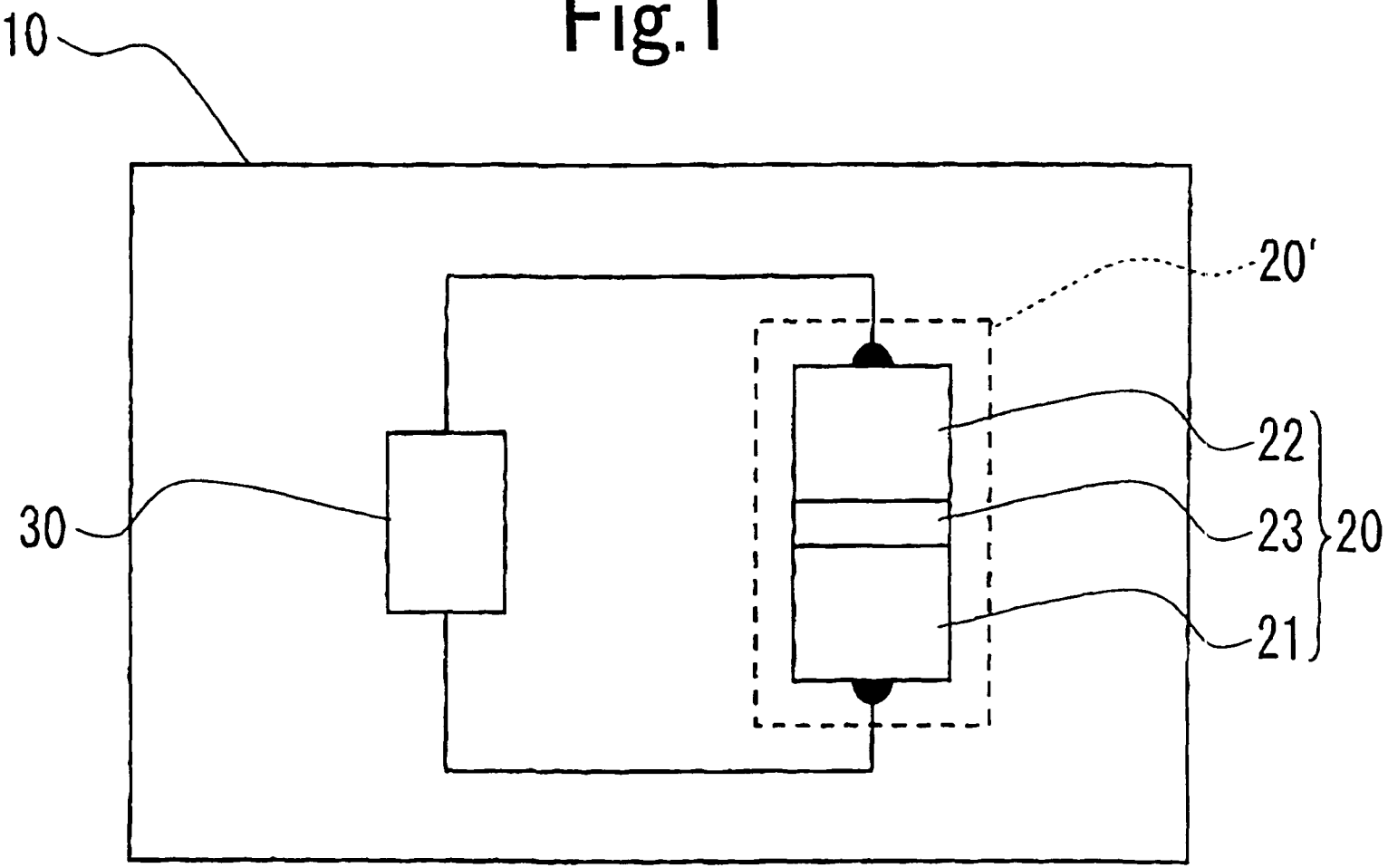
FIG. 1 is an outline diagram of an electronic device according to an embodiment of the present invention.

In the electronic device and the light emission control method for an electronic device according to the present invention, the electronic device includes: a light emitting section that emits light by utilizing recombination of electrons and holes; and a driving section that outputs a driving signal to be inputted to the light emitting section so as to control its light emission. Then, the light emitting section emits light intermittently in response to a driving signal having a pulsed shape of a duty ratio higher than or equal to 0.7 and lower than 1.0.

In particular, when the electron density is denoted by n, the hole density is denoted by p, the thermal velocity of electrons is denoted by $v_{th:n}$, the thermal velocity of holes is denoted by $v_{th:p}$, the electron capture cross section of a defect level present in the light emitting section is denoted by $\sigma_n$, the hole capture cross section of a defect level present in the light emitting section is denoted by $\sigma_p$, and the pulse width of the driving signal is denoted by W, the driving section generates a driving signal of a pulse width W satisfying $$W<1/\{n\cdot v_{th:n}\cdot\sigma_n\cdot p\cdot v_{th:p}\cdot\sigma_p/(n\cdot v_{th:n}\cdot\sigma_n+p\cdot v_{th:p}\cdot\sigma_p)\}$$

and then inputs the signal to the light emitting section.

When a driving signal of a pulse width W satisfying the above-mentioned condition is adopted, at the time of energization of the light emitting section by using the driving signal, a situation is suppressed that electrons and holes are both captured in defect levels present in the light emitting section so as to recombine with each other. Thus, generation of recombination energy can be suppressed that causes multiplication and diffusion of defect levels. As a result, degradation of the semiconductor layer in the light emitting section is suppressed, and hence lifetime improvement is achieved.

Here, the theory of electron-hole recombination in defect levels is described below briefly. As known, the electron-hole recombination rate U of defect levels per defect density $N_t$ [$cm^{-3}$] is given by the following formula.

$$U=v_{th:n}\sigma_n v_{th:p}\sigma_p(p\cdot n-n_i^2)/(\sigma_p(p+n_i\exp\{(E_i-E_t)/kT\})+\sigma_n(n+n_i\exp\{(E_t-E_i)/kT\}))$$

where

U: electron-hole recombination rate [1/sec]

$v_{th:n}$: thermal velocity of electrons ($=\sqrt{(3kT/m_n^*)}$) [cm/sec]

$v_{th:p}$: thermal velocity of holes ($=\sqrt{(3kT/m_p^*)}$) [cm/sec]

k: Boltzmann's constant [J/K]

T: absolute temperature [K]

$m_n^*$: effective mass of the electron [kg]

$m_p^*$: effective mass of the hole [kg]

$\sigma_n$: electron capture cross section of the defect level [$cm^2$]

$\sigma_p$: hole capture cross section of the defect level [$cm^2$]

n: electron density [$cm^{-3}$]

p: hole density [$cm^{-3}$]

$n_i$: intrinsic carrier density [$cm^{-3}$]

$E_i$: intrinsic Fermi level [J]

$E_t$: defect level [J]

When the light emitting section is in an operating state where carriers composed of electrons or holes are injected therein, that is, when the light emitting section is in a predetermined energized state, the formula given above is approximated into the following formula.

$$U \approx n \cdot C_n p \cdot C_p / (n \cdot C_n + p \cdot C_p)$$

where $C_n$: electron capture coefficient of the defect level ($C_n = v_{th:n} \cdot \sigma_n$) [$cm^3$/sec]

$C_p$: hole capture coefficient of the defect level ($C_p = v_{th:p} \cdot \sigma_p$) [$cm^3$/sec].

In general, the electron capture coefficient $C_n$ of the defect level and the hole capture coefficient $C_p$ of the defect level are different from each other. Thus, the formula given above is approximated further. In this case, the electron-hole recombination rate U per defect density is $$U \approx n \cdot C_n, \ (nC_n << pC_p) \ [1/\text{sec}]$$

$$U \approx p \cdot C_p, \ (nC_n >> pC_p) \ [1/\text{sec}].$$

This indicates that the electron-hole recombination rate of the defect levels is controlled by the lower one of the carrier capture rates.

Further, as seen from consideration based on this formula, in order that an electron and a hole should be prevented from recombining in the defect level of one defect, it is sufficient that carrier injection is completed in a time length less than the time length necessary for the recombination of an electron and a hole in the defect level.

Further, even in a case that either an electron or a hole is trapped in the defect level, recombination of an electron and a hole does not occur when the other hole or electron is not trapped in the defect level.

Thus, without causing a problem, the value of recombination rate may be set equal to the greater one of the product between the carrier density of the electron and the carrier capture coefficient of the electron captured in the defect level and the product between the carrier density of the hole and the carrier capture coefficient of the hole captured in the defect level.

In conclusion, it is sufficient that carriers are injected within a time length smaller than the inverse of the carrier capture rate that controls the electron-hole recombination rate U, that is, $1/n \cdot C_n$ [sec] in the case of $nC_n << pC_p$ and $1/p \cdot C_p$ [sec] in the case of $nC_n >> pC_p$.

Thus, in the case of $nC_n << pC_p$, $C = C_n$ is adopted, and the carrier density is set equal to the electron density. In the case of $nC_n >> pC_p$, $C = C_p$ is adopted, and the carrier density is set equal to the hole density. Further, the pulse width of the driving signal is denoted by W [sec], and the carrier capture coefficient of a defect that controls the electron-hole recombination rate in the defect levels is denoted by C [$cm^{-3}$/sec]. Then, a driving condition for the light emitting section for suppressing the electron-hole recombination in the defect levels is that the pulse width of the driving signal satisfies the condition $W < 1/nC = 1/U$ [sec/1 pulse]. In other words, it is sufficient that the pulse width of the driving signal is set smaller than a time length necessary for the reaction that an electron and a hole are captured in a defect level so as to recombine with each other.

Here, the "1" on the right-hand side of $W < 1/nC$ [sec/1 pulse] indicates the number of carriers captured in one defect level within the pulse width of one pulse of the driving signal, that is, the time length that the light emitting section is in an ON state. This quantity is equal to the amount of carrier capture per one pulse (carriers/1 pulse). Thus, the W in the condition formula gives a pulse width for the driving signal that permits no electron-hole recombination in the defect level of one defect.

Here, at the time of setting up the period of the driving signal and the duty ratio of the driving signal, the period and the duty ratio may be set up arbitrarily as long as the pulse width W of the driving signal satisfies the condition "$W < 1/U$." In particular, even when the duty ratio of the driving signal is set to be 0.7 or higher in accordance with a condition of luminance or the like in the light emitting section, enhancement of the lifetime of the light emitting section is achieved.

Here, the pulse width W of the driving signal indicates the time length where the light emitting section is in an ON state. Thus, for simplicity of description, this quantity is referred to as the "element operation time," hereinafter.

In the semiconductor layer part of a light emitting section, in many cases, a plurality of defect levels are present instead of a situation that a single defect level is solely present.

Thus, when the element operation time (pulse width W of the driving signal) and the electric current value of the driving signal that sets forth the injection rate of electrons and holes into the light emitting section are set equal to the element operation time and the electric current value corresponding to the defect level to be suppressed, multiplication and diffusion of the defect level is suppressed, and hence degradation of the semiconductor layer of the light emitting section is suppressed.

That is, for example, in a case that a defect kind 1 and a defect kind 2 are present and that their electron-hole recombination rates are different from each other, the element operation time and the electric current value of the driving signal are set up in accordance with the electron-hole recombination rate of a defect kind to be suppressed among the electron-hole recombination rate $n_1C_1$ of the defect kind 1 and the electron-hole recombination rate $n_2C_2$ of the defect kind 2. By virtue of this, degradation of the semiconductor layer of the light emitting section caused by this defect kind is suppressed.

Alternatively, when the higher one of the electron-hole recombination rates is selected, in addition to suppression of degradation caused by the defect kind corresponding to this electron-hole recombination rate, degradation of the semiconductor layer of the light emitting section caused by the defect kind corresponding to the lower one of the electron-hole recombination rates can be suppressed. Accordingly, when the highest one of the electron-hole recombination rates is selected, the lifetime of the light emitting section can be enhanced to the greatest extent.

Further, in a light emission control circuit of the driving section for outputting the driving signal, on the basis of the element operation time in the outputted driving signal or alternatively on the basis of the output time of the outputted driving signal and the duty ratio of the driving signal, the light emission time in which the light emitting section emits light may be accumulated successively. This accumulated light emission time may be stored. Then, on the basis of the accumulated light emission time, the element operation time may be changed.

That is, for example, during the time when the value of the accumulated light emission time is small, a small number of defects are present in the semiconductor layer of the light emitting section, and hence the element operation time may be set relatively long. Then, with increasing value of the accumulated light emission time, the number of defects increases as a result also of the influence of natural deterioration and the like. Thus, the element operation time may be reduced gradually.

Hereinafter, embodiments of the present invention are described below in detail with reference to the drawings. As shown in FIG. 1, an electronic device 10 according to the present embodiment includes: a light emitting section 20' provided with a light emitting element that emits light by utilizing recombination of electrons and holes; and a driving section 30 that inputs a pulse-shaped driving signal to the light emitting section 20' so as to cause the light emitting section 20' to emit light intermittently.

Here, the electronic device 10 may be arbitrary, and is, for example, a lighting device or a display device having a light emitting element. Specifically, such lighting devices include: a lighting tool capable of projecting light of a predetermined wavelength; headlights in an automobile, a motorcycle, a bicycle, or the like; a searchlight; a flashlight; a penlight; and a backlight for a liquid crystal display. Further, an example of display devices is a device such as a traffic signal and a warning light provided with one or a plurality of light emitting diodes or the like.

The following description is given for a case that the light emitting element of the light emitting section 20' is composed of a zinc selenide (ZnSe)-based white LED (Light Emitting Diode) which is a II-VI group compound semiconductor and a gallium nitride (GaN)-based ultraviolet LED which is a group III-V semiconductor. However, the light emitting element is not limited to a light emitting element composed of a crystalline material, and may be arbitrary as long as it is a light emitting element of a so-called carrier injection type provided with an active layer composed of a quantum well layer sandwiched between a P-type semiconductor layer and an N-type semiconductor layer.

The Znse-based white LED 20 serving as a light emitting element of the present embodiment is constructed in the form of a PIN type diode in which a ZnCdSe/ZnSe multiple quantum well active layer 23 is sandwiched between an N-type semiconductor layer 21 formed using zinc chloride ($ZnCl_2$) as an n-type dopant and a P-type semiconductor layer 22 formed using nitrogen ($N_2$) gas as a p-type dopant.

The N-type semiconductor layer 21 and the P-type semiconductor layer 22 are each connected via an electrode to a light emission control circuit of the driving section 30. The light emission control circuit inputs a driving signal having a predetermined pulsed shape to the Znse-based white LED 20, so that the Znse-based white LED 20 emits light intermittently.

Specifically, the Znse-based white LED 20 of the present embodiment is constructed on a substrate composed of a conductive n-type ZnSe single crystal (100). On the lower surface of this substrate, a titanium (Ti) film and a gold (Au) film are stacked so that an electrode is formed.

On the single crystal ZnSe substrate, the following semiconductor layers are formed by molecular beam epitaxy (MBE). Here, at the time of formation of each semiconductor layer, zinc (Zn), magnesium (Mg), cadmium (Cd), sulfur (S), selenium (Se), and tellurium (Te) having a purity of six nines are supplied appropriately from a Knudsen cell, so that an epitaxial thin film crystal is grown up.

On the single crystal ZnSe substrate, with doping zinc chloride ($ZnCl_2$) as an n-type dopant, an n-ZnSe buffer layer of approximately 1.0 μm and an n-ZnMgSSe cladding layer of approximately 0.5 μm are formed so that an N-type semiconductor layer 21 is formed on the single crystal ZnSe substrate. Here, the effective carrier density in the n-ZnSe buffer layer is $7\times10^{17}$ $cm^{-3}$, while the effective carrier density in the n-ZnMgSSe cladding layer is $5\times10^{17}$ $cm^{-3}$.

On the upper surface of the n-ZnMgSSe cladding layer, an i-ZnSe carrier confining layer of approximately 0.03 μm, a ZnCdSe/ZnSe multiple quantum well active layer 23 of approximately 0.01 μm, and an i-ZnSe layer of approximately 0.03 μm are formed sequentially. Then, on the i-ZnSe layer, a P-type semiconductor layer 22 is formed.

The P-type semiconductor layer 22 is formed by sequentially stacking a p-ZnMgSSe layer of approximately 0.5 μm, a p-ZnSe layer of approximately 0.5 μm, a multiple quantum well ZnSe/ZnTe layer of approximately 40 nm, and a p-ZnTe contact layer of approximately 40 nm. On the upper surface of the p-ZnTe contact layer, gold (Au) is vapor-deposited so that a metal electrode is formed. The effective carrier density in the p-ZnMgSSe layer is $3\times10^{16}$ $cm^{-3}$, while the effective carrier density in the p-ZnSe layer is $4\times10^{17}$ $cm^{-3}$, and while the effective carrier density in the p-ZnTe contact layer is $2\times10^{19}$ $cm^{-3}$.

Here, the multiple quantum well ZnSe/ZnTe layer is called a superlattice electrode and formed for the purpose of providing a pseudo-ohmic electrode layer on the p-type ZnSe crystal. Further, since the multiple quantum well ZnSe/ZnTe layer for superlattice electrode and then the p-ZnTe contact layer are provided on the p-ZnSe layer, holes can be transported between the p-ZnSe layer and the p-ZnTe contact layer by virtue of a resonant tunneling effect.

The Znse-based white LED 20 (referred to simply as the "LED element," hereinafter) constructed as described above was fixed to a sample holder of a cryostat. Then, the pressure inside the cryostat was set to be $10^{-4}$ Pa or lower. After that, the LED element was driven with a pulse current in response to the driving signal.

Figure 2:
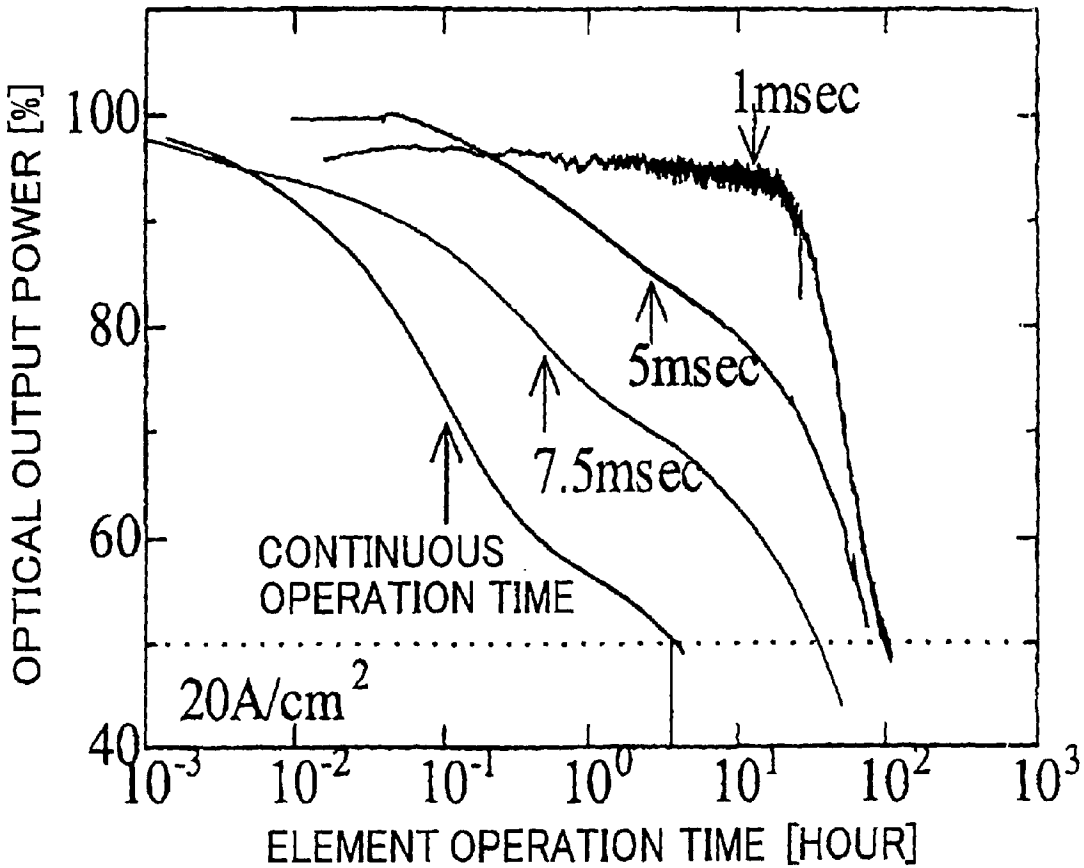
FIG. 2 is a graph showing element operation time characteristics of an optical output power of a Znse-based white LED element.

FIG. 2 shows the result of an element drive experiment in which transition of the optical output power of the LED element 20 was measured for each element operation time condition under an accelerated deterioration test condition that the temperature of the sample holder inside the cryostat was set to be 333 K and that the LED element 20 was energized with a pulse current having a current density of 20 $A/cm^2$.

In this element drive experiment, the period of the driving signal having a pulsed shape was 10 msec, while the element operation time in each driving signal was any one of 7.5 msec, 5 msec, and 1 msec. Then, transition of the optical output power was measured for each of these conditions. Further, as a comparison example, transition of the optical output power was measured with a condition of continuous light emission of the LED element 20. Here, in FIG. 2, the element operation time of the LED element 20 in the cases that a pulse-shaped driving signal is inputted indicates the accumulated time of the element operation time portion in the driving signal.

In the case of continuous light emission of the LED element 20, the half-life was approximately 3 hours. In contrast, when the element operation time was 5 msec, the half-life increases to approximately 80 hours. This indicates improvement of a factor of approximately 25. In particular, when the element operation time is 5 msec, the actual element operation time is approximately 160 hours.

Figure 3:
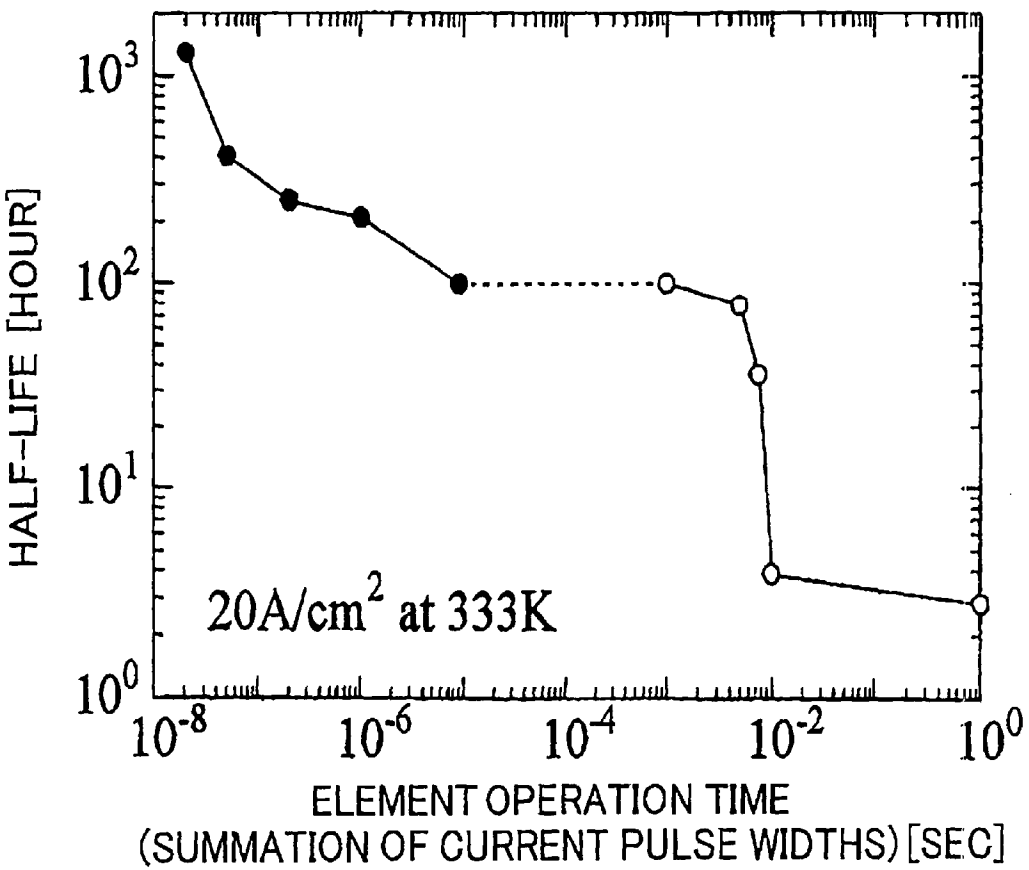
FIG. 3 is a graph showing dependence of the half-life of a Znse-based white LED element on element operation time characteristics.

FIG. 3 is a graph showing the element operation time dependence of the half-life of the LED element 20. Here, the half-life shown on the vertical axis of the graph indicates a value equivalent to continuous light emission. As obviously seen from this graph, the lifetime of the LED element 20 depends on the element operation time (pulse width of the drive pulse current) in the drive pulse current. In particular, when the element operation time becomes smaller than $1\times10^{-2}$ sec, the half-life of the LED element 20 exceeds 100 hours and hence reaches approximately 50 times the half-life of the case of continuous operation time.

Here, an explanation is given below that the enhancement of the lifetime of the LED element 20 achieved by reducing the element operation time is attributed to the fact that the condition formula W<1/nC (sec/1 pulse) described above is satisfied.

First, an explanation is given below for the cause of degradation of the LED element 20 generated in accordance with the light emission of the LED element 20.

In the LED element 20 of the present embodiment, in general, defects called H0 defects are present that are caused by nitrogen doped as acceptors in the P-type semiconductor layer 22. The H0 defect levels formed in the H0 defects easily capture free holes. Thus, in accordance with the operation of the LED element 20, electrons overflow from the active layer 23 to the P-type semiconductor layer 22, and then these overflowed electrons are captured in the H0 defect levels, so that non-light-emitting recombination of electrons and holes occurs in the H0 defect levels.

The recombination energy released in accordance with the recombination of electrons and holes in the H0 defect levels causes multiplication and diffusion of the H0 defects in the active layer, so that the active layer is degraded and so is the LED element 20. This is an accepted idea. That is, carrier capture which is simultaneous capture of electrons and holes in the H0 defects serves as a driving force for degradation of the LED element 20.

The carrier capture cross section $\sigma$ of the H0 defect level of the H0 defect is known to be $10^{-22}$ [$cm^2$] for the free hole and $10^{-18}$ [$cm^2$] for the free electron according to a measurement by Double Carrier Deep Level Transient Spectroscopy (DC-DLTS).

During the operation of the LED element 20, when carriers are injected in response to the driving signal, the carrier capture rates of the H0 defect level are as follows: the electron capture rate $nC_n=10^8$ (1/sec) and the hole capture rate $pC_p=10^2$ (1/sec). Here, since $nC_n>>pC_p$, the electron-hole recombination rate U per defect density in the H0 defect levels is given by $U\approx pC_p=10^2$ (1/sec). This indicates that this rate is controlled by the hole capture.

Thus, in order that the recombination of electrons and holes should be suppressed in the H0 defect levels, it is sufficient that the condition formula of element drive is set to be $W<1/pC_p$ and that the element operation time W is set to be $W<10^{-2}$ sec.

Obviously, this condition ($W<10^{-2}$ sec) agrees well with the experimental value shown in FIG. 3. That is, in the LED element 20, when driving is performed with a condition of $W<10^{-2}$ sec, capture of holes in the H0 defect levels is suppressed, so that recombination of electrons and holes are suppressed. As a result, multiplication and diffusion of the H0 defects is suppressed. Thus, degradation of the LED element 20 is suppressed, and hence the lifetime is enhanced.

Here, in the region of an element operation time of $1\times10^{-3}$ sec$<W<1\times10^{-6}$ sec in the graph of FIG. 3, the lifetime of the LED element 20 is saturated at approximately 100 hours. In contrast, in the region of $W>1\times10^{-6}$ sec, the lifetime of the LED element 20 extends further. This indicates that defects different from the H0 defects are present in the LED element 20.

A known defect different from the H0 defect is a donor-nature defect of a compensation type that undergoes multiplication in the P-type semiconductor layer 22 of the LED element 20. In particular, it is known that the donor-nature defect also undergoes multiplication and diffusion as a result of the recombination energy generated in the recombination of electrons and holes in the defect levels.

The carrier capture cross section $\sigma$ of the donor-nature defect level of the donor-nature defect is known to be $10^{-17}$ [$cm^2$] for the free hole according to a measurement by transitional capacitance spectroscopy. Then, since the thermal velocity $v_{th}$ of the hole is $2\times10^7$ [cm/sec], an element operation time of $W<10^{-7}$ sec is required from the condition formula of W<1/nC.

Thus, when the element operation time W is set smaller than $10^{-7}$ sec, capture of holes in the donor-nature defect levels in the donor-nature defects can be suppressed. Thus, recombination of electrons and holes can be suppressed, and hence multiplication and diffusion of the donor-nature defects is suppressed. Thus, degradation of the LED element 20 is suppressed, and hence the lifetime is enhanced. This agrees well with the experimental values shown in the graph of FIG. 3.

As such, as obviously seen in FIG. 3, in the LED element 20, a smaller element operation time W results in a longer lifetime.

Figure 4:
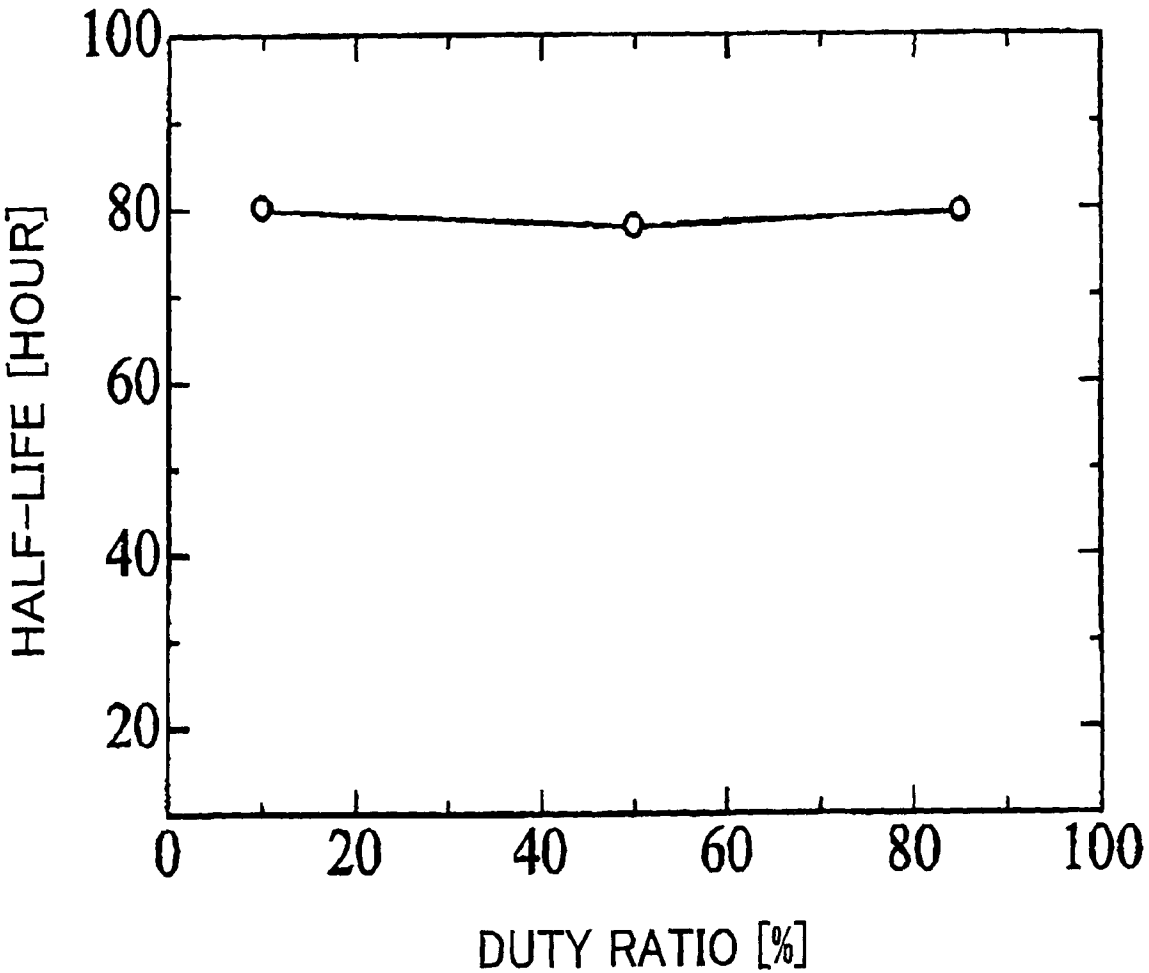
FIG. 4 is a graph showing duty ratio dependence of the half-life of a Znse-based white LED element.

FIG. 4 is a graph showing the result of measurement of the half-life of the LED element 20 with a condition that the element operation time of the driving signal inputted to the LED element 20 was a constant value of 5 msec and that the driving signal of a diverse duty ratio was inputted to the LED element 20. Here, the temperature in the cryostat was set to 333 K, while current density of the current provided to the LED element 20 in response to the driving signal was 20 A/$cm^2$. The offset voltage was 0 V.

As obviously seen in FIG. 4, the lifetime of the LED element 20 does not depend on the duty ratio. Thus, for the purpose of lifetime improvement in the LED element 20, the element operation time in the driving signal is solely important.

Figure 5:
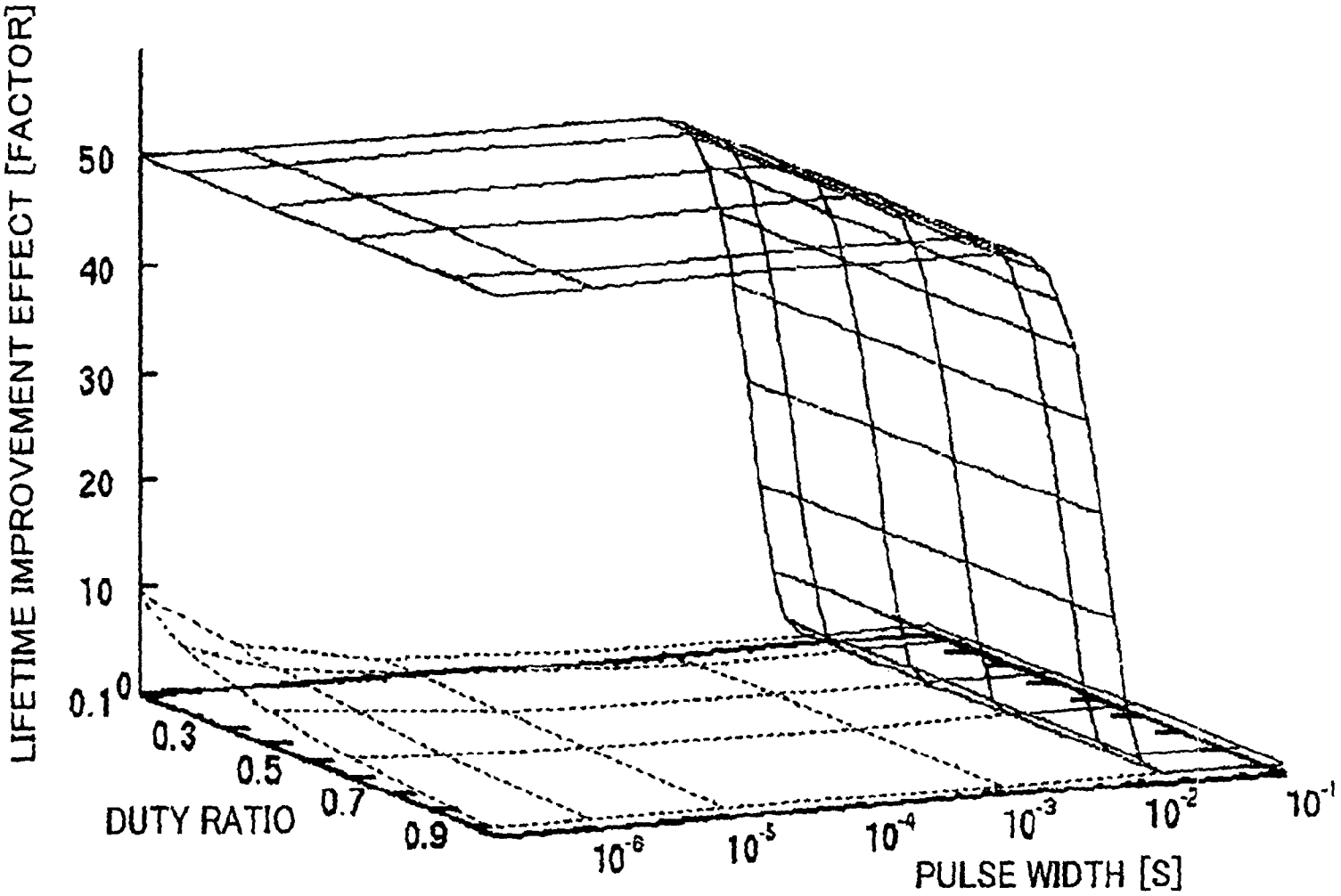
FIG. 5 is a graph showing a lifetime improvement effect in a Znse-based white LED element.

FIG. 5 is a graph showing the improvement effect for the lifetime of the LED element 20 as a function of the duty ratio and the element operation time in the driving signal. In FIG. 5, the dash-dotted line indicates as a comparison example the improvement effect for the lifetime obtained when the pulse width and the duty ratio were set to be the values proposed in Japanese Published Unexamined Patent Application No. H09-052389 (Patent Document 2).

As shown in FIG. 5, in comparison with the conventional method where the duty ratio is adjusted in order to enhance the lifetime, when the element operation time is adjusted as in the present invention, a remarkable lifetime improvement effect is obtained. In particular, the effect is independent of the duty ratio of the driving signal. Thus, even in a case that the duty ratio is set to be 0.7 or higher depending on the condition of luminance or the like, a satisfactory enhancement effect for the lifetime can be expected when the element operation time W is set smaller than $10^{-2}$ sec.

In a reversed manner, the result of the measurement experiment for the lifetime of the LED element 20 shown in FIG. 3 can be used for determination of the electron-hole recombination rate in the defect level that controls the rate of the degradation of the LED element 20. That is, in the graph of FIG. 3, the inverse of the element operation time value at which the lifetime of the LED element 20 remarkably steps up gives the electron-hole recombination rate, which is the value of the electron-hole recombination rate in the H0 defect, the donor-nature defect, or the like.

The enhancement effect for the lifetime of the LED element 20 achieved by reduction of the element operation time W shown in the graph of FIG. 3 is, as described above, attributed to the fact that the reduction of the element operation time W suppresses recombination of electrons and holes captured in defect levels. However, another possible interpretation is that as an avoidable result of the setup of the experimental condition, the reduction of the element operation time W causes reduction in the duty ratio of the driving signal and hence suppression in the Joule heat generated in the LED element 20 so that lifetime improvement is obtained.

Figure 6:
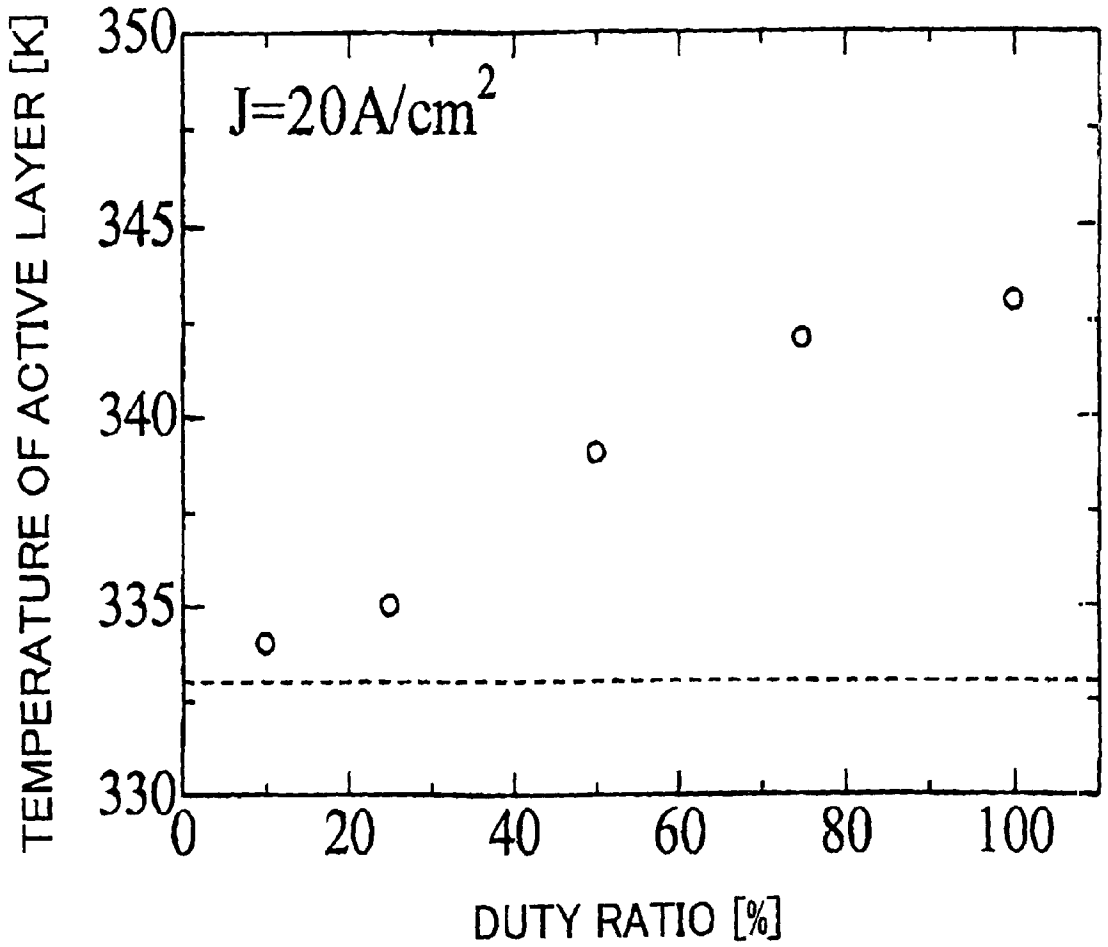
FIG. 6 is a graph showing duty ratio dependence of the temperature in an active layer of a Znse-based white LED element.

Thus, a test was performed for the relevance between the duty ratio of the driving signal and the temperature of the LED element 20. FIG. 6 is a graph obtained by measuring the temperature of the active layer in the LED element 20 in a state that the LED element 20 performed light emission in response to a driving signal having a predetermined duty ratio. Here, the temperature of the active layer was estimated on the basis of a basic experiment, that is, estimated from comparison between the peak shift characteristics of the emission spectrum depending on the temperature and the duty ratio dependence of the peak shift of the emission spectrum.

As shown in FIG. 6, it was confirmed that when the duty ratio of the driving signal was reduced, the temperature of the active layer decreased. Specifically, the temperature decreased from approximately 344 K to approximately 334 K. Here, this experiment was performed in a state that the LED element 20 was accommodated in a cryostat at $10^{-4}$ Pa or lower and a temperature of 333 K. In the driving signal inputted to the LED element 20, the period was fixed at 20 msec, while the element operation time was 1 to 10 msec. The current density of a current provided to the LED element 20 in response to the driving signal was 20 A/cm$^2$, while the offset voltage was approximately −10V. The applied voltage during the element operation time was approximately 2.5 V.

In the experiment from which the graph of FIG. 3 was obtained, the duty ratio was set to be 50%. Thus, from the graph shown in FIG. 6, the temperature decrease is estimated to be 5° C. or the like.

Figure 7:
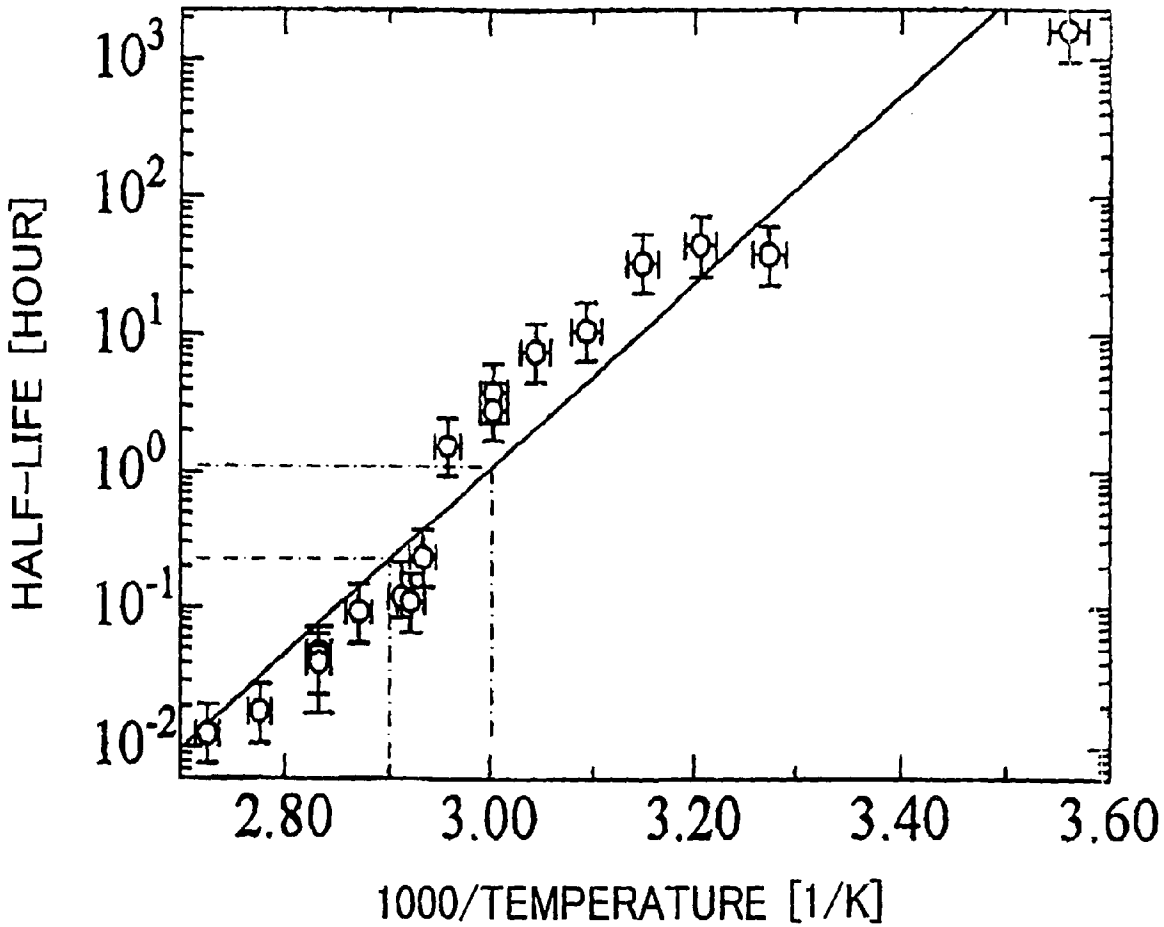
FIG. 7 is a graph showing 1/T characteristics of the half-life of a Znse-based white LED element with respect to element deterioration caused by H0 defects.

Temporarily, if the temperature decreases from 344K to 334K, as seen from the 1/T characteristics graph shown in FIG. 7 for the half-life of the LED element 20 with respect to degradation of the active layer caused by H0 defects, the half-life at 343K is approximately 0.2 hours while the half-life at 334K is approximately 1 hour. Thus, the effect of enhancement of the lifetime of the LED element obtained by the temperature decrease only is estimated to be a factor of approximately 5. This does not account for the effect of a factor of approximately 50 shown in FIG. 3. Accordingly, this effect of lifetime improvement in the LED element is obviously attributed to a reduction in the element operation time. Here, 1000/344 [K]≈2.9 [1/K] and 1000/334 [K]≈3.0 [1/K].

Figure 8:
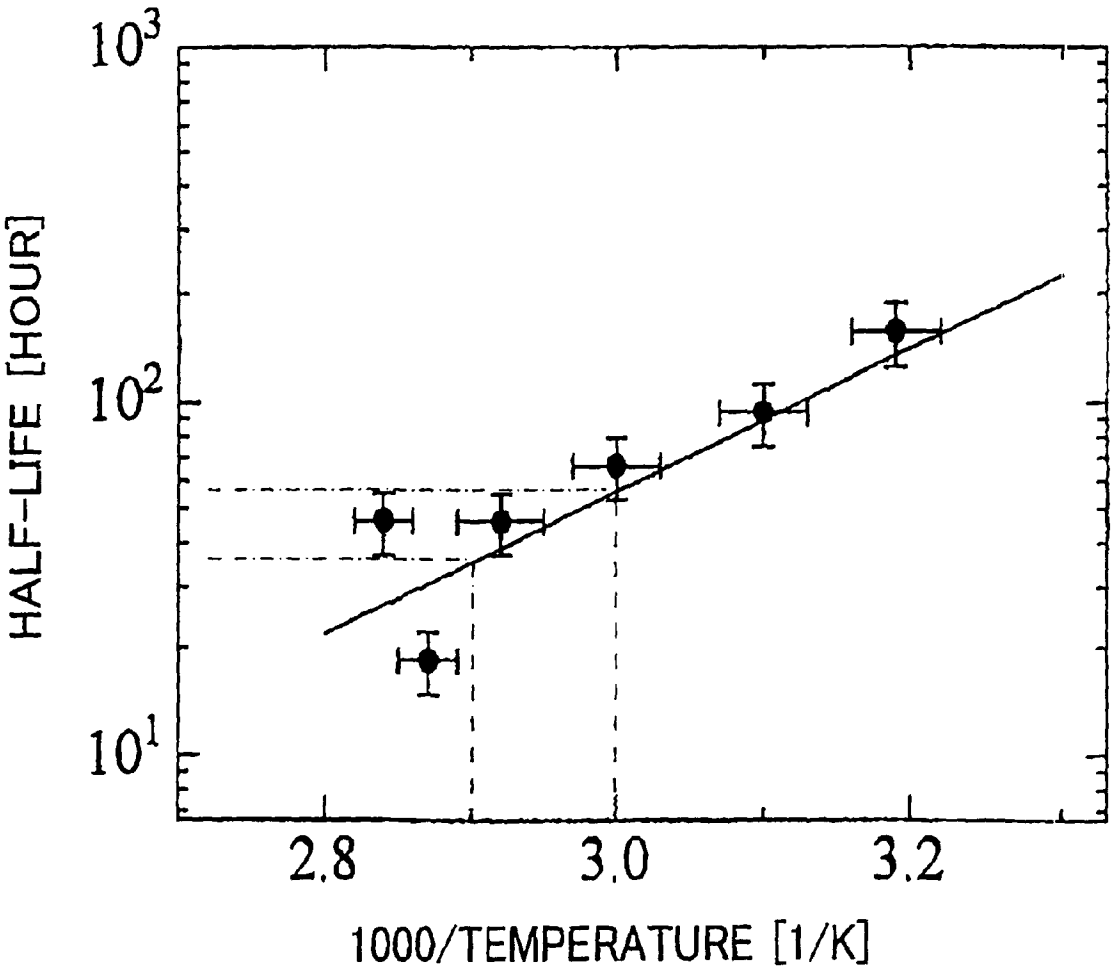
FIG. 8 is a graph showing 1/T characteristics of the half-life of a Znse-based white LED element with respect to element deterioration caused by deep donor centers.

Similarly, as seen from the 1/T characteristics graph shown in FIG. 8 for the half-life of the LED element with respect to degradation of the active layer caused by donor-nature defects, the half-life at 344K is approximately 30 hours while the half-life at 334K is approximately 60 hours. Thus, the effect of enhancement of the lifetime of the LED element obtained by the temperature decrease only is estimated to be a factor of approximately 2. This does not account for the effect of a factor of approximately 13 shown in FIG. 3. Accordingly, this effect of lifetime improvement in the LED element is obviously attributed to a reduction in the element operation time.

Further, if the lifetime improvement in the LED element were attributed to the suppression heat generation caused by the reduced duty ratio, this interpretation cannot account for the fact that an enhancement effect having two steps in the element lifetime as shown in the graph of FIG. 3 is obtained when the element operation time solely is reduced at a fixed duty ratio.

Thus, obviously, the enhancement of the lifetime of the LED element is not an effect resulting from the temperature decrease in the LED element caused by a reduction in the duty ratio.

Another embodiment is described below for the case of a gallium nitride (GaN)-based ultraviolet LED which is a group III-V semiconductor.

The GaN-based ultraviolet LED element is constructed in the form of a PIN type diode in which an InGaN/GaN multiple quantum well active layer is sandwiched between an N-type semiconductor layer formed using, as an n-type dopant, silicon (Si) supplied from mono silane ($SiH_4$) and a P-type semiconductor layer formed using, as a p-type dopant, magnesium (Mg) supplied from methylcyclopentadienyl magnesium ($(C_5H_5)_2Mg$).

Specifically, the GaN-based ultraviolet LED 20 is constructed on a single crystal sapphire substrate (0001). On this substrate, the following semiconductor layers are formed by Metal Organic Vapor Phase Epitaxy (MOVPE). Here, at the time of formation of each semiconductor layer, liquid trimethylgallium ($Ga(CH_3)_3$) for supplying gallium, ammonia ($NH_3$) for supplying nitrogen, trimethylaluminum ($Al(CH_3)_3$) for supplying aluminum, and solid-state trimethylindium ($In(CH_3)_3$) are supplied appropriately using hydrogen as carrier gas, so that an epitaxial thin film crystal was grown up on a single crystal sapphire substrate.

On the single crystal sapphire substrate, with doping silicon (Si) as an n-type dopant, an n-GaN buffer layer of approximately 5.0 μm and an n-AlGaN cladding layer of approximately 0.5 μm are formed so that an N-type semiconductor layer is formed. Here, the effective carrier density in the n-GaN buffer layer is $2\times10^{18}$ cm$^{-3}$, while the effective carrier density in the n-AlGaN cladding layer is $5\times10^{17}$ cm$^{-3}$.

On the upper surface of the n-AlGaN cladding layer, an i-GaN carrier confining layer of approximately 0.03 μm, an InGaN/GaN multiple quantum well active layer 23 of approximately 0.01 μm, and an i-GaN layer of approximately 0.03 μm are formed sequentially. Then, on the i-GaN layer, a P-type semiconductor layer is formed.

The P-type semiconductor layer is constructed by sequentially stacking a p-AlGaN layer of approximately 0.1 μm, a p-AlGaN/GaN superlattice cladding layer of approximately 0.5 μm, and a p-GaN contact layer of approximately 0.1 μm. On the upper surface of the p-GaN contact layer, nickel (Ni) and gold (Au) are vapor-deposited so that a metal electrode is formed. The effective carrier density in the p-AlGaN layer is $5\times10^{17}$ cm$^{-3}$ while the effective carrier density in the p-AlGaN/GaN superlattice cladding layer is $2\times10^{18}$ cm$^{-3}$, and while the effective carrier density in the p-GaN contact layer is $1\times10^{19}$ cm$^{-3}$.

Here, for the purpose of forming a metal electrode on the N-type semiconductor, a necessary mask is formed on the single crystal sapphire substrate by a photolithography technique. Then, the single crystal sapphire substrate is etched to an extent that the n-GaN buffer layer is exposed. Then, titanium (Ti) and gold (Au) are vapor-deposited into the opening formed by the etching, so that a metal electrode serving as an ohmic electrode is formed.

The GaN-based ultraviolet LED constructed as described above was fixed to the sample holder of a cryostat. Then, the pressure inside the cryostat was set to be $10^{-4}$ Pa or lower. Then, a driving signal having a predetermined element operation time was inputted to the GaN-based ultraviolet LED so as to cause the GaN-based ultraviolet LED to emit light.

Figure 9:
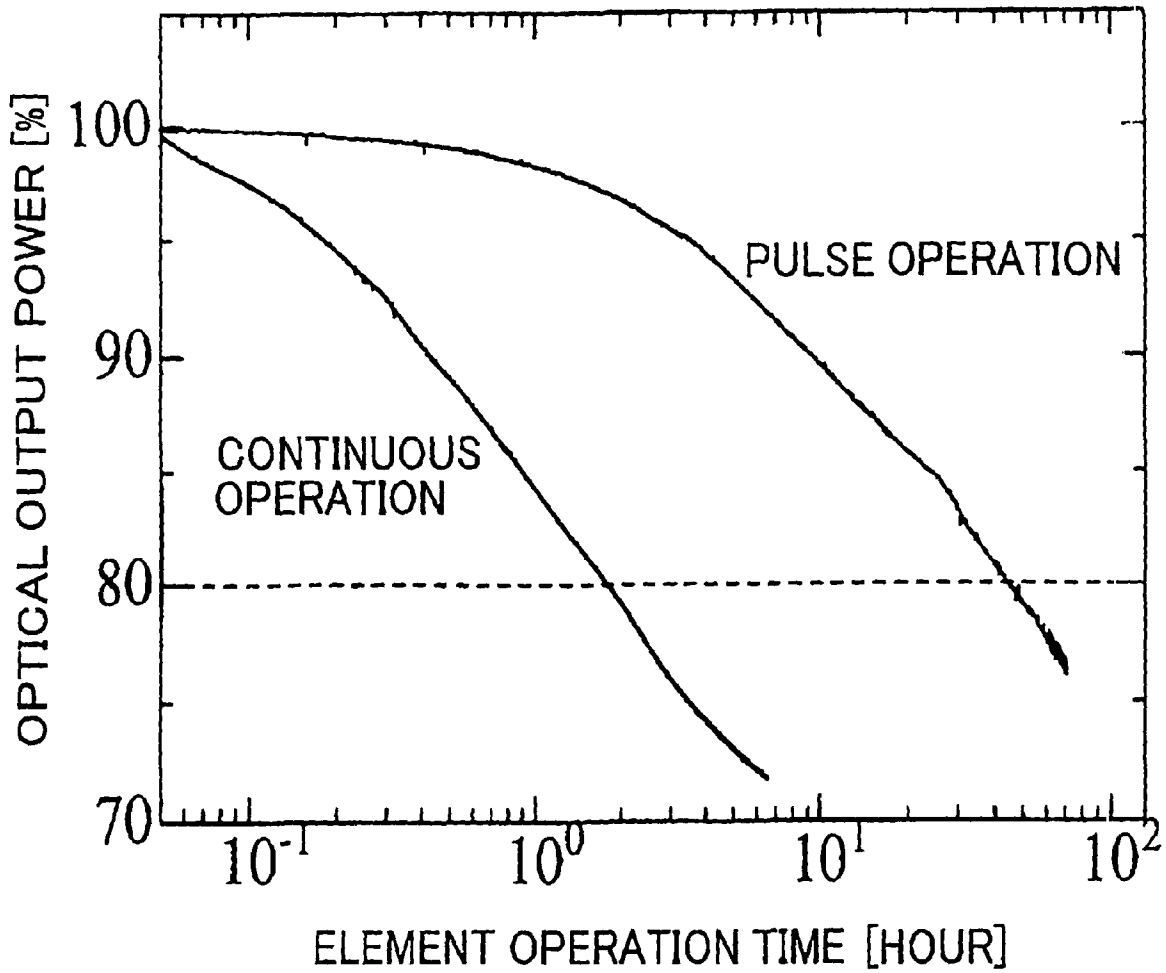
FIG. 9 is a graph showing element operation time characteristics of an optical output power of a GaN-based ultraviolet LED element.

FIG. 9 is a graph showing transition of the optical output power of GaN-based ultraviolet LED obtained in an accelerated deterioration test performed with a condition that the temperature of the sample holder inside the cryostat was set to be 450 K and that the current density of the current provided to the GaN-based ultraviolet LED in response to the driving signal was 83 A/cm$^2$. The driving signal in the case of pulse drive was a rectangular wave having an element operation time of 50 nsec and a duty ratio of 0.25.

As seen from FIG. 9, the time having elapsed until the optical output power of GaN-based ultraviolet LED decreased to 80% was 1.7 hours in the case of continuous light emission of the GaN-based ultraviolet LED. In contrast, when intermittent light emission was performed by means of pulse drive of the GaN-based ultraviolet LED in response to a pulse-shaped driving signal, the elapsed time was 43 hours, which was approximately 25 times the above-mentioned value. Here, the element operation time on the horizontal axis of FIG. 9 in the case of pulse drive of the GaN-based ultraviolet LED indicates the accumulation time of the element operation time length in each cycle in the driving signal.

As such, obviously, the enhancement of the lifetime of the light emitting element achieved by reduction of the element operation time of the driving signal is not limited by a crystalline material constituting the light emitting element.

Thus, also for light emitting elements of II-VI group zinc oxide (ZnO)-based like the ZnCdO-based, the ZnMgO-based, the ZnBeO-based, and the ZnOTe-based as well as III-V group gallium arsenide (GaAs)-based light emitting elements, aluminum gallium arsenide (AlGaAs)-based light emitting elements, gallium phosphorus (GaP)-based light emitting elements, indium phosphorus (InP)-based light emitting elements, aluminum nitride (AlN)-based light emitting elements, boron nitride (BN)-based light emitting elements, InAs-based light emitting elements, GaAsP-based light emitting elements, InGaAsP-based light emitting elements, InGaP-based light emitting elements, InN-based light emitting elements, InGaN-based light emitting elements, AlGaN-based light emitting elements, InAlGaN-based light emitting elements, and GaInNAs-based light emitting elements, a similar effect can be expected, and hence lifetime improvement is achieved in a semiconductor light emitting element, an LED, a laser diode, or the like of a carrier injection type that utilizes recombination of electrons and holes.

In particular, in the present invention, the scope of the light emitting section that emits light by utilizing recombination of electrons and holes is not limited to a light emitting element composed of a semiconductor, and includes optical output power devices such as an organic electroluminescence, an inorganic electronics material, and a fluorescent substance in which the recombination of electrons and holes in defect levels causes multiplication of defects so as to cause a decrease in the optical output power. Even in these optical output power devices, when the element operation time in the pulse-shaped driving signal is set up in accordance with the condition for suppressing the recombination of electrons and holes in defect levels, the effect of lifetime improvement can be expected.

That is, for example, in the case of an organic electroluminescence element, defects are present that are formed around a nucleus composed of oxygen, water, and the like present in the thin film of the organic electroluminescence element. Then, recombination of electrons and holes in the defect levels in these defects causes multiplication of defects, so that the luminance decreases. However, when recombination of electrons and holes in the defect levels is suppressed by adjusting at least the element operation time for the driving signal having a pulsed shape, the effect of lifetime improvement can be expected.

Similarly, even in the case of fluorescent substances that emit light by utilizing recombination of electrons and holes, like yttrium aluminum garnet (YAG), silver-aluminum-doped zinc sulfide (ZnS:Ag,Al), copper-aluminum-doped zinc sulfide (ZnS:Cu,Al), europium-doped yttrium sulfide oxygen ($Y_2O_2S$:Eu), oxides of zinc and silicon ($Zn_2SiO_4$), and calcium nitride aluminum silicon ($CaAlSiN_3$), decrease in the luminance generated in those fluorescent substances is caused by the process that electrons and holes recombine with each other in the defect levels in the defects present in the fluorescent substance and that the released recombination energy causes multiplication of defects. Then, when recombination of electrons and holes in the defect levels is suppressed by adjusting at least the element operation time for the driving signal having a pulsed shape, the effect of lifetime improvement can be expected.

In the embodiments described above, the driving signal had the shape of a rectangular wave. However, the waveform is not limited to a rectangular wave, and may be a triangular wave, a sine wave, or a wave of a predetermined shape. Further, the signal need not necessarily be a periodic pulse wave, and it is sufficient that the element operation time W is smaller than the inverse of the electron-hole recombination rate nC, that is, $W<1/nC$.

Further, the element operation time in the driving signal need not always be smaller than "1/nC." That is, in order that a condition for necessary luminance should be satisfied, the element operation time may temporarily be set greater than "1/nC," while the element operation time may periodically be set smaller than "1/nC."

The period and the duty ratio of the driving signal are adjusted by a light emission control circuit of the driving section. The driving signal may be inputted to the light emitting section by appropriately switching the waveform when necessary.

In particular, in the light emitting element constituting the light emitting section, in addition to defects accidentally formed at a manufacturing stage of the light emitting element, defects can occur spontaneously as a result of cosmic rays and the like in some cases. Thus, multiplication of defects can occur as a result of a cause other than the recombination of electrons and holes in the defect levels in the defects. Thus, the light emission control circuit of the driving section may measure the accumulated value of the operating time of the light emitting element, and then input to the light emitting section a driving signal having an element operation time adjusted on the basis of the accumulated operating time.

According to the present invention, in an electronic device having a light emitting section that emits light by utilizing recombination of electrons and holes, lifetime improvement is achieved in the light emitting section. By virtue of this, a light emitting device that was not able to be used as a result of an insufficient lifetime obtained in the case of continuous light emission is allowed to be used as the light emitting section. Alternatively, lifetime improvement is achieved in an electronic device having a light emitting section. Thus, an electronic device can be provided that has improved consumer convenience.

What is claimed is:

1. An electronic device comprising:

a light emitting section that emits light by utilizing recombination of electrons and holes; and a driving section that inputs to the light emitting section a pulse-shaped driving signal having a duty ratio higher than or equal to 0.7 and lower than 1.0 and thereby causes the light emitting section to emit light intermittently, wherein when an electron density is denoted by n, a hole density is denoted by p, a thermal velocity of electrons is denoted by $v_{th:n}$, a thermal velocity of holes is denoted by $v_{th:p}$, an electron capture cross section of a defect level present in the light emitting section is denoted by $\sigma_n$, a hole capture cross section of a defect level present in the light emitting section is denoted by $\sigma_p$, and a pulse width of the driving signal is denoted by W, the driving section inputs to the light emitting section the driving signal having a pulse width W that satisfies $$W<1/\{n\cdot v_{th:n}\cdot\sigma_n\cdot p\cdot v_{th:p}\cdot\sigma_p/(n\cdot v_{th:n}\cdot\sigma_n+p\cdot v_{th:p}\cdot\sigma_p)\}.$$

2. The electronic device according to claim 1, wherein the pulse width W of the driving signal is set to be $$W<1/n\cdot v_{th:n}\cdot\sigma_n \text{ in a case of } n\cdot v_{th:n}\cdot\sigma_n<<p\cdot v_{th:p}\cdot\sigma_p \text{ and}$$

$$W<1/p\cdot v_{th:p}\cdot\sigma_p \text{ in a case of } n\cdot v_{th:n}\cdot\sigma_n>>p\cdot v_{th:p}\cdot\sigma_p.$$

3. A light emission control method for an electronic device, comprising a step of inputting, to a light emitting section that emits light by utilizing recombination of electrons and holes, a pulse-shaped driving signal having a duty ratio higher than or equal to 0.7 and lower than 1.0 and thereby causing the light emitting section to emit light intermittently, wherein when an electron density is denoted by n, a hole density is denoted by p, a thermal velocity of electrons is denoted by $v_{th:n}$, a thermal velocity of holes is denoted by $v_{th:p}$, an electron capture cross section of a defect level present in the light emitting section is denoted by $\sigma_n$, a hole capture cross section of a defect level present in the light emitting section is denoted by $\sigma_p$, and a pulse width of the driving signal is denoted by W, $$W<1/\{n\cdot v_{th:n}\cdot\sigma_n\cdot p\cdot v_{th:p}\cdot\sigma_p/(n\cdot v_{th:n}\cdot\sigma_n+p\cdot v_{th:p}\cdot\sigma_p)\}$$

is satisfied.

4. The light emission control method for an electronic device according to claim 3, wherein the pulse width W of the driving signal is set to be $$W<1/n\cdot v_{th:n}\cdot\sigma_n \text{ in a case of } n\cdot v_{th:n}\cdot\sigma_n<<p\cdot v_{th:p}\cdot\sigma_p \text{ and}$$

$$W<1/p\cdot v_{th:p}\cdot\sigma_p \text{ in a case of } n\cdot v_{th:n}\cdot\sigma_n>>p\cdot v_{th:p}\cdot\sigma_p.$$

* * * * *